US010522122B2

(12) United States Patent
Tsukada

(10) Patent No.: US 10,522,122 B2
(45) Date of Patent: Dec. 31, 2019

(54) MUSIC BOX APPARATUS

(71) Applicant: Yujin Tsukada, Saitama (JP)

(72) Inventor: Yujin Tsukada, Saitama (JP)

(73) Assignee: Yujin Tsukada, Saitama-shi, Saitama (JP)

( * ) Notice: Subject to any disclaimer, the term of this patent is extended or adjusted under 35 U.S.C. 154(b) by 0 days.

(21) Appl. No.: 16/065,632

(22) PCT Filed: Dec. 22, 2016

(86) PCT No.: PCT/JP2016/088338
§ 371 (c)(1),
(2) Date: Jun. 22, 2018

(87) PCT Pub. No.: WO2017/110998
PCT Pub. Date: Jun. 29, 2017

(65) Prior Publication Data

US 2019/0266984 A1 Aug. 29, 2019

(30) Foreign Application Priority Data

Dec. 25, 2015 (JP) ..... 2015-253905

(51) Int. Cl.
*G10F 1/06* (2006.01)
*G10F 5/04* (2006.01)

(52) U.S. Cl.
CPC . *G10F 1/06* (2013.01); *G10F 5/04* (2013.01)

(58) Field of Classification Search
CPC ..... G10F 1/06; G10F 5/04
See application file for complete search history.

(56) References Cited

U.S. PATENT DOCUMENTS

2015/0000507 A1* 1/2015 Nakamura ..... G10F 1/06 84/612

FOREIGN PATENT DOCUMENTS

| | | | |
|---|---|---|---|
| JP | H6-69996 | U | 3/1994 |
| JP | H9-101775 | A | 4/1997 |
| JP | H11-15467 | A | 1/1999 |

OTHER PUBLICATIONS

Antique Orugoru no Miryoku ( 2) , [online], Sep. 26, 2012 (Sep. 26, 2012), [retrieval date Feb. 8, 2017 (Feb. 8, 2017) J, Internet: <URL: http://kenthouse.exblog.jp/16414154>.
CD-ROM of the specification and drawings annexed to the request of Japanese Utility Model Application No. 15060/1993 (Laid-open No. 69996/11994)(Kawai Musical Instruments Mfg. Co., Ltd.), Sep. 30, 1994 (Sep. 30, 1994), entire text; all drawings(Family: none).
International Search Report dated Feb. 21, 2017 on related PCT Application No. PCT/JP2016/088338, filed Dec. 22, 2016.

* cited by examiner

*Primary Examiner* — Kimberly R Lockett
(74) *Attorney, Agent, or Firm* — EIP US LLP

(57) ABSTRACT

Provided is a novel music box device that can play music for a long time and can also suppress a thickness.
The present invention relates to a music box device including: a sheet that has a playing engagement part and is rotated by a driving means; a star wheel arranged oppositely to the sheet and having two or more claws on an outer peripheral surface; and a vibration valve arranged adjacent to the star wheel. In the music box device, as the sheet is rotated by the driving means, the playing engagement part is linked with one claw to rotate the star wheel while another claw plucks the vibration valve to play music, and the sheet has a helical plate shape.

5 Claims, 15 Drawing Sheets

(a)

(b)

(a)

(b)

(a)

(b)

MUSIC BOX APPARATUS

TECHNICAL FIELD

The present invention relates to a music box device, and particularly to a music box device capable of playing music for a long time.

BACKGROUND ART

Conventionally, as a music box device for playing music by plucking vibration valves having different scales at predetermined timings, there is known a cylinder type music box device in which pins to be engaged with individual vibration valves are provided on an outer peripheral surface of a cylinder at a predetermined pitch. In order to play music for a long time in such a cylinder type music box device, there is a problem that a thickness of the music box device becomes very thick since a diameter of the cylinder must be increased.

On the other hand, in place of a configuration in which a vibration valve is directly plucked by a pin of a cylinder, there is also known a tape type music box device (e.g., refer to Patent Literature 1) that includes a star wheel rotatably held and having a plurality of claws on an outer peripheral surface, and a tape having through holes drilled at a predetermined pitch. In this music box device, the star wheel is rotated by engaging one claw of the star wheel with the through hole along with the feeding of the tape, enabling another claw of the star wheel to pluck the vibration valve to play music. According to such a tape type music box device, increasing a length of the tape allows music to be played for a long time. There is also known a disc type music box for playing music with a circular disc instead of the above-mentioned tape (e.g., refer to Patent Literature 2)

CITATION LIST

Patent Literature

Patent Literature 1: JP H9-101775 A
Patent Literature 2: JP H11-15467 A

SUMMARY OF INVENTION

Technical Problem

Meanwhile, with such a tape type music box device, it is necessary to provide two rolls, that is, a feeding roll wound with a tape before playing, and a receiving roll to be wound with a tape after playing, leading to an increase in the number of components. Moreover, along with the feeding of the tape, a tape diameter of the feeding roll becomes smaller while a tape diameter of the receiving roll becomes larger, which requires gradual change of a rotational speed of the two rolls in order to make a feeding speed of the tape constant, leading to complication of the mechanism. Furthermore, in order to play music for a long time, the tape diameter of the roll also increases as the length of the tape increases, so that the overall thickness of the music box device has also tended to be thick in combination with an increase in the number of components and complication of the mechanism. On the other hand, since a disc type music box uses a thin disc, it is possible to reduce the overall thickness of the music box device, but there has also been limitation in extending a playing time since a music length that can be played depends on a circumferential length of the disc.

The present invention has been made to solve such problems, and an object thereof is to provide a novel music box device capable of playing music for a long time and also suppressing a thickness.

Solution to Problem

The present invention relates to a music box device including: a sheet that has a playing engagement part and is rotated by a driving means; a star wheel arranged oppositely to the sheet and having two or more claws on an outer peripheral surface; and a vibration valve arranged adjacent to the star wheel, in which, as the sheet is rotated by the driving means, the playing engagement part is linked with one claw to rotate the star wheel, and another claw plucks the vibration valve to play music.

In this music box device, the sheet has a helical plate shape.

The driving means preferably includes a first rotary disc connected to one end of the sheet, a second rotary disc connected to another end of the sheet, and a synchronizing mechanism to synchronously rotate the first rotary disc and the second rotary disc.

The driving means includes a shaft that is rotated by a driving part and holds the star wheel to be idly rotatable; and a shaft gear that is provided on the shaft and transmits a rotational force of the shaft to a rotary-disc drive gear connected to the first rotary disc, to rotate the first rotary disc. The music box device includes a knob provided movably along a center axis of the first rotary disc and rotatable around this center axis. The knob includes a driving engaged part that is engaged with a driving engagement part provided on the first rotary disc to rotate the first rotary disc, and a shaft movement engagement part that moves the shaft together with the knob. Preferably, when the knob is moved in a direction away from the first rotary disc, the music box device is brought into a playable state where the driving engagement part and the driving engaged part are disengaged while the rotary-disc drive gear and the shaft gear are engaged with each other. Whereas, preferably, when the knob is moved in a direction to approach the first rotary disc, the music box device is brought into a sheet feeding state where the driving engagement part and the driving engaged part are engaged with each other while the shaft movement engagement part moves the shaft to disengage the rotary-disc drive gear from the shaft gear, and to separate the star wheel from the sheet.

It is preferable to provide a cover plate including a spiral groove provided facing at least one of the first rotary disc and the second rotary disc, and a pin movable in the spiral groove, and at least one of the first rotary disc and the second rotary disc facing the cover plate preferably has a radial groove extending in a radial direction and holding the pin movably.

The driving means preferably includes a shaft to integrally rotate a spacer that holds the star wheel to be idly rotatable and is provided coaxially with the star wheel. The driving means preferably further includes a sheet pressing mechanism having: a driving roller that sandwiches the sheet in between with the spacer and is rotated by the driving means to feed out the sheet; and a pressing roller that is mounted to a drive shaft to be rotated together with the driving roller, and brings the sheet toward the spacer.

Preferably, the driving roller is configured to rotate the sheet at a rotational speed consistent with the first rotary disc and the second rotary disc.

Advantageous Effects of Invention

In the music box device according to the present invention, since a helical plate-like sheet is used as a medium to pluck the vibration valve via the star wheel, it is possible to play music for a long time. Moreover, the helical plate-like sheet allows an un-played portion and a played portion to be stacked with each other to form a layer, enabling suppression of the thickness of the music box device.

Further, when there are provided, as a driving means to rotate the sheet, the first rotary disc connected to one end of the sheet, the second rotary disc connected to another end of the sheet, and the synchronizing mechanism to synchronously rotate the first rotary disc and the second rotary disc, a local load is not applied to the sheet, and the sheet can be stably rotated since the entire sheet can be integrally rotated.

Moreover, when the music box device is provided with the above-described knob provided to be movable along the center axis of the first rotary disc and rotatable around the center axis, moving the knob in the direction away from the first rotary disc can bring the music box device into the playable state where the driving engagement part and the driving engaged part are disengaged while the rotary-disc drive gear and the shaft gear are engaged with each other. Whereas, moving the knob in the direction to approach the first rotary disc can bring the music box device into the sheet feeding state where the driving engagement part and the driving engaged part are engaged with each other, the rotary-disc drive gear and the shaft gear are disengaged, and the star wheel moves away from the sheet. That is, moving the knob in the direction away from the first rotary disc allows music to be played as usual, and moving the knob in the direction to approach the first rotary disc and rotating enables fast forwarding and rewinding of the sheet at a high speed.

Further, when there are provided the cover plate including the spiral groove provided facing at least one of the first rotary disc and the second rotary disc, and the pin movable in the spiral groove, and at least one of the first rotary disc and the second rotary disc facing the cover plate is provided with the radial groove extending in the radial direction and holding the pin movably, it is possible to grasp progress of the music being played, with the position of the pin since the pin also moves along with the rotation of the sheet.

When the driving means is provided with the shaft to integrally rotate the spacer that holds the star wheel to be idly rotatable and is provided coaxially with the star wheel, and the driving means is provided with the sheet pressing mechanism having: the driving roller that sandwiches the sheet in between with the spacer and is rotated by the driving means to feed out the sheet; and the pressing roller that is mounted to the drive shaft to be rotated together with the driving roller, and brings the sheet toward the spacer, the sheet can be rotated more stably since the sheet can be fed out by the spacer and the driving roller. Further, although a speed is different between an inner side and an outer side in the radial direction since the sheet has a disc shape in a plan view, wrinkles or twists do not occur in the sheet since the driving roller is only the roller to feed out the sheet while the pressing roller does not positively feed out the sheet.

Moreover, since it is possible to synchronously rotate all of the first rotary disc, the second rotary disc, and the sheet by configuring the driving roller to rotate the sheet at a rotational speed consistent with the first rotary disc and the second rotary disc, no extra load is applied to the sheet.

DESCRIPTION OF EMBODIMENTS

Figure 1:
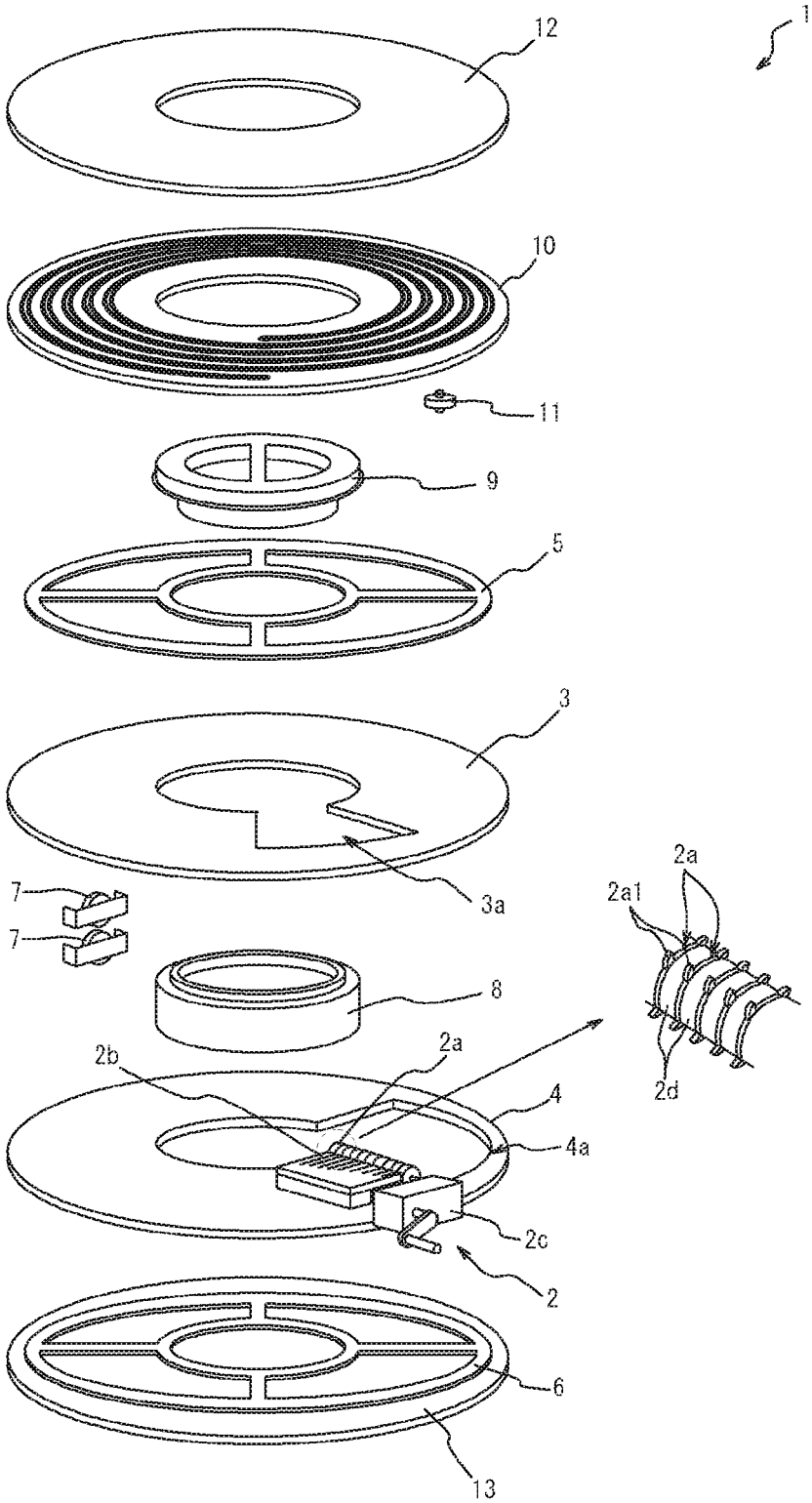
FIG. 1 is an exploded perspective view schematically showing individual components (excluding a sheet and the like) relating to one embodiment of a music box device according to the present invention.

Hereinafter, an embodiment of a music box device according to the present invention will be described with reference to the drawings. In this specification, "upper" is a side on which a protective plate (reference numeral 12) is located with respect to a bottom plate (reference numeral 13) in FIG. 1, and "lower" is a side opposite to the upper side.

Figure 2:
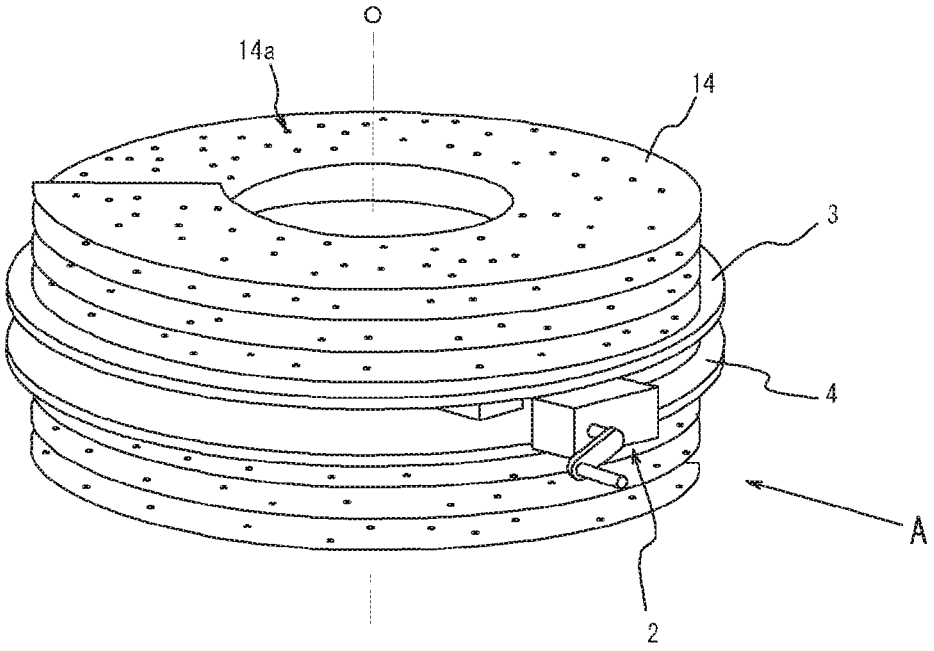
FIG. 2 is a perspective view showing a state where the components (including the sheet) shown in FIG. 1 are partially assembled.

In the drawings, reference numeral 1 indicates the music box device of the present embodiment. As schematically shown in FIG. 1, the music box device 1 includes: a music box body 2; an upper partition plate 3; a lower partition plate 4; an upper rotary disc (first rotary disc) 5; a lower rotary disc (second rotary disc) 6; a synchronizing gear 7; a connecting member 8; a knob 9; a top plate (cover plate) 10; a pin 11; the protective plate 12; and the bottom plate 13. Although not shown in FIG. 1, the music box device 1 further includes a sheet 14 as shown in FIG. 2. Furthermore, the music box device 1 includes a lock mechanism 15 shown in FIGS. 3 and 5, and a shaft depression assisting mechanism 16.

Figure 4:
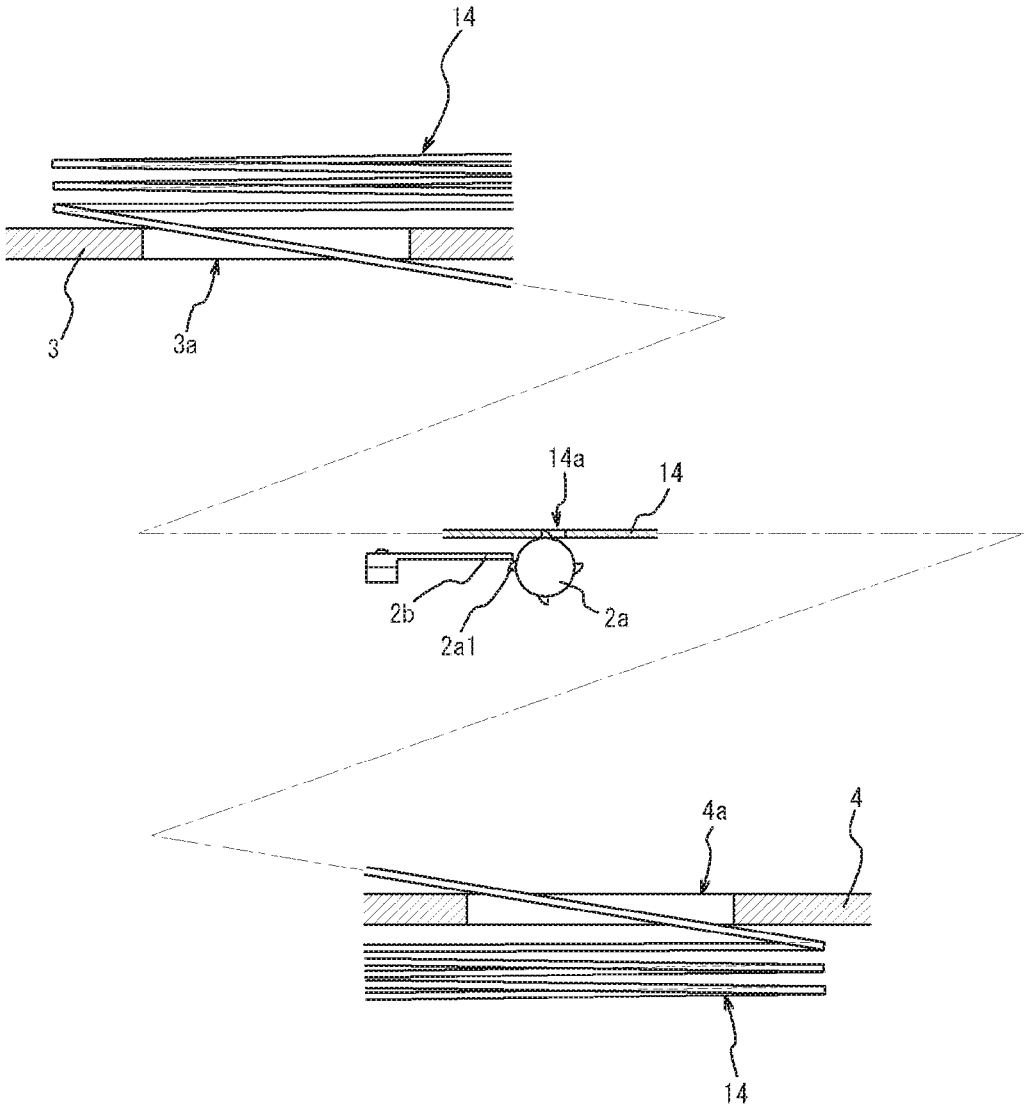
FIG. 4 is a schematic view along an arrow A shown in FIG. 2.

As shown in FIG. 1, the music box body 2 includes: a plurality of star wheels 2*a* arranged along a center axis; a plurality of vibration valves 2*b* arranged adjacently to the star wheels 2*a* and aligned at positions corresponding to the respective star wheels 2*a*; and a driving means 2*c* to apply a rotational force to the sheet 14. As shown in FIG. 4, the star wheel 2*a* includes two or more claws 2*a*1 on its outer peripheral surface. Moreover, as shown in FIG. 1, a disc-like spacer 2*d* is provided coaxially with the star wheels 2*a*, between the adjacent star wheels 2*a*.

Figure 3:
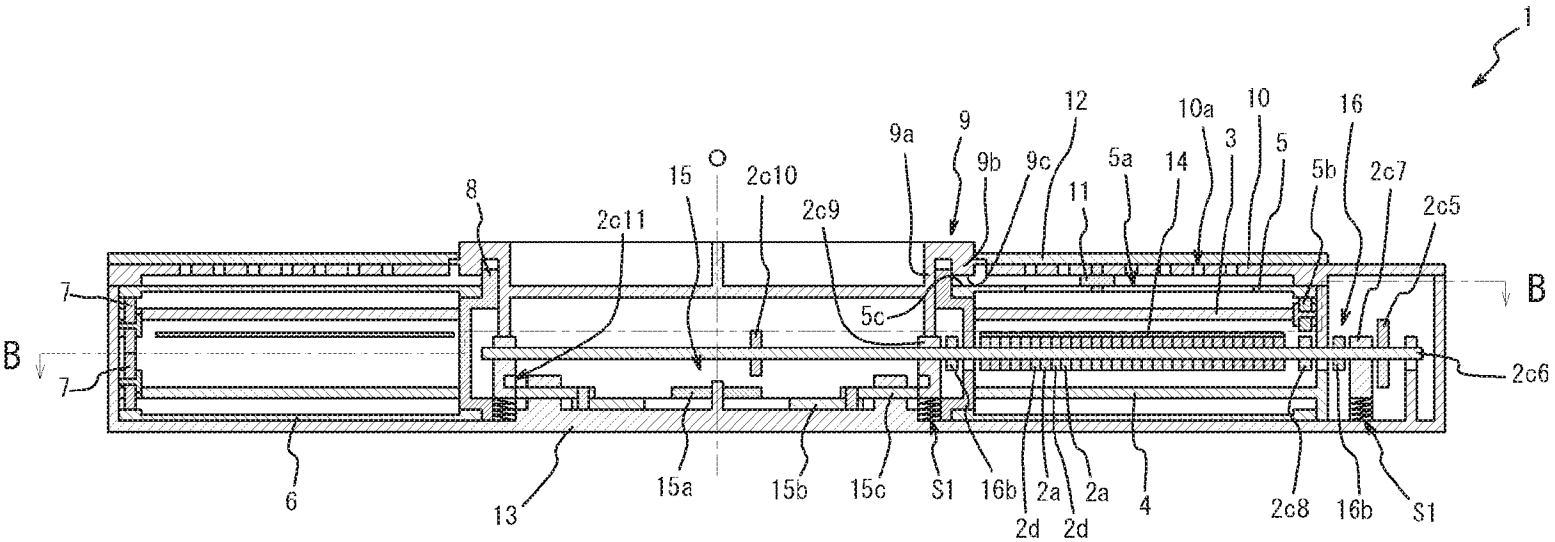
FIG. 3 is a cross-sectional view of the music box device shown in FIG. 1 in a side view.
Figure 5:
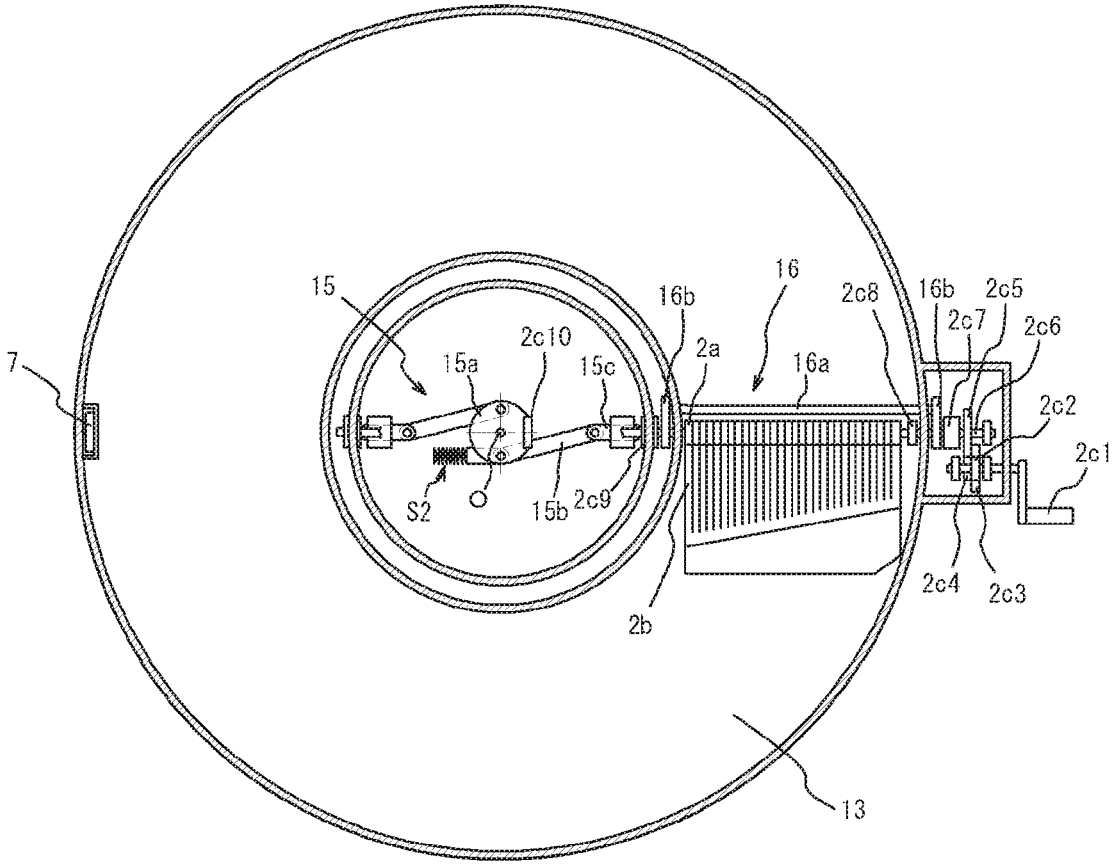
FIG. 5 is a cross-sectional view taken along line B-B shown in FIG. 3.
Figure 8:
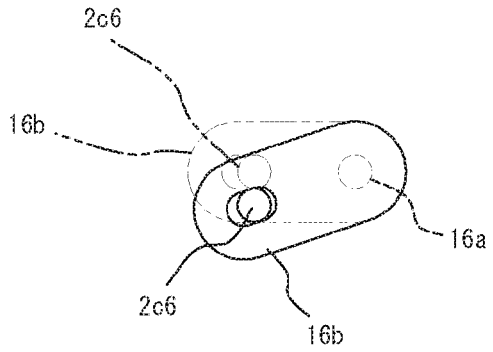
FIG. 8 is a view showing an arrow view along an arrow C shown in FIG. 7 by superposing views before depressing the knob (virtual line) and after depressing (solid line), in which FIG. 8(*a*) is a view showing a relationship of a shaft depression assisting mechanism, and FIG. 8(*b*) is a view showing a relationship of a driving means.
Figure 8:
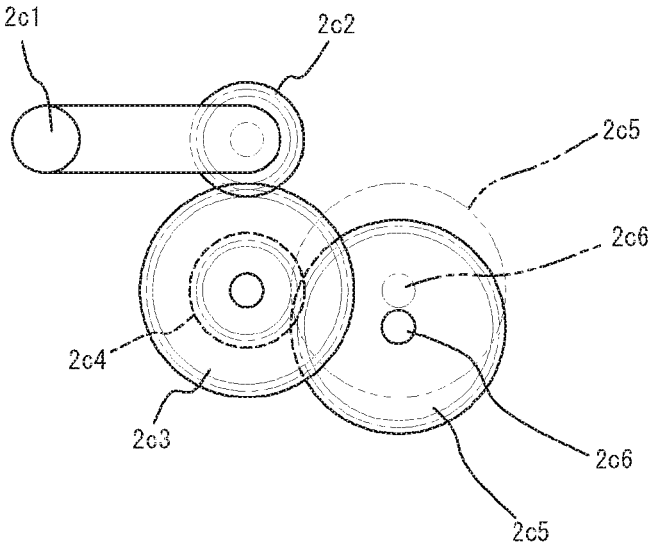

Further, as shown in FIGS. 5 and 8(*b*), the driving means 2*c* includes: a handle 2*c*1 to be rotated by hand; and a first gear 2*c*2 to transmit a rotational force of the handle 2*c*1, and further includes a shaft 2*c*6 that is rotated via three gears (a second gear 2*c*3, a third gear 2*c*4, and a fourth gear 2*c*5) (the fourth gear 2*c*5 and the shaft 2*c*6 are rotated integrally). As shown in FIGS. 3 and 5, the shaft 2*c*6 extends long from the outer side toward the inner side in the radial direction of the music box device 1. Further, the shaft 2*c*6 includes a columnar first support part 2*c*7 supporting the shaft 2*c*6 rotatably near the fourth gear 2*c*5, and a shaft gear 2*c*8 that is rotated integrally with the shaft 2*c*6, and the shaft 2*c*6 holds the plurality of star wheels 2*a* so as to skewer the star wheels 2*a* to be idle rotatable. While the shaft 2*c*6 holds the star wheels 2*a* together with the spacer 2*d* so as to skewer, the spacer 2*d* is attached to the shaft 2*c*6 by a means such as an interference fit and rotated integrally with the shaft 2*c*6. Further, the shaft 2*c*6 is rotatably supported by a pair of second support parts 2*c*9 that become columnar at a center part of the music box device 1, and a locking gear 2*c*10 to be rotated integrally with the shaft 2*c*6 is provided between the second support parts 2*c*9. Here, each of the second support parts 2*c*9 includes a recess 2*c*11 that is concaved from the radially inner side to the outer side on a surface facing a center axis O of the music box device 1. Note that the recess 2*c*11 may be a through hole penetrating the second support part 2*c*9. Then, as shown in FIG. 3, a spring S1 is provided under the first support part 2*c*7 and the pair of second support parts 2*c*9, and an urging force is applied to the shaft 2*c*6 from bottom to top. While the fourth gear 2*c*5 is movable in a vertical direction together with the shaft 2*c*6, even when the shaft 2*c*6 is lowered as shown in FIG. 8(*b*), the fourth gear 2*c*5 and the third gear 2*c*4 mesh with each other.

As shown in FIG. 1, the upper partition plate 3 is provided above the driving means 2*c*, and a hole 3*a* is provided inside the driving means 2*c*. The lower partition plate 4 is provided below the driving means 2*c*, and a hole 4*a* is provided inside the lower partition plate 4.

As shown in FIG. 2, the sheet 14 is formed in a helical plate shape extending so as to turn around the center axis O of the music box device 1. The sheet 14 of the present embodiment is made of a thin plastic, but is not limited to this material. Further, the sheet 14 of the present embodiment is formed in the helical plate shape by radially cutting a sheet formed in a doughnut shape in advance, and joining the plurality of the cut sheets together, but the forming method is not limited to this. Here, there are provided a plurality of playing engagement parts 14*a* that are engaged with the claws 2*a*1 of the star wheel 2*a* when the sheet 14 is rotated, at predetermined positions on the sheet 14. The playing engagement parts 14*a* of the present embodiment are through holes penetrating the sheet 14, but may be protrusions protruding toward the claw 2*a*1.

Then, as shown in FIG. 4, an upper portion of the sheet 14 is stacked and placed so as to form a layer on the upper partition plate 3, and passes through the hole 3*a* and over the star wheel 2*a* to reach the hole 4*a* of the lower partition plate 4. A lower portion of the sheet 14 having passed through the hole 4*a* is stacked and placed so as to form a layer below the lower partition plate 4.

Figure 6:
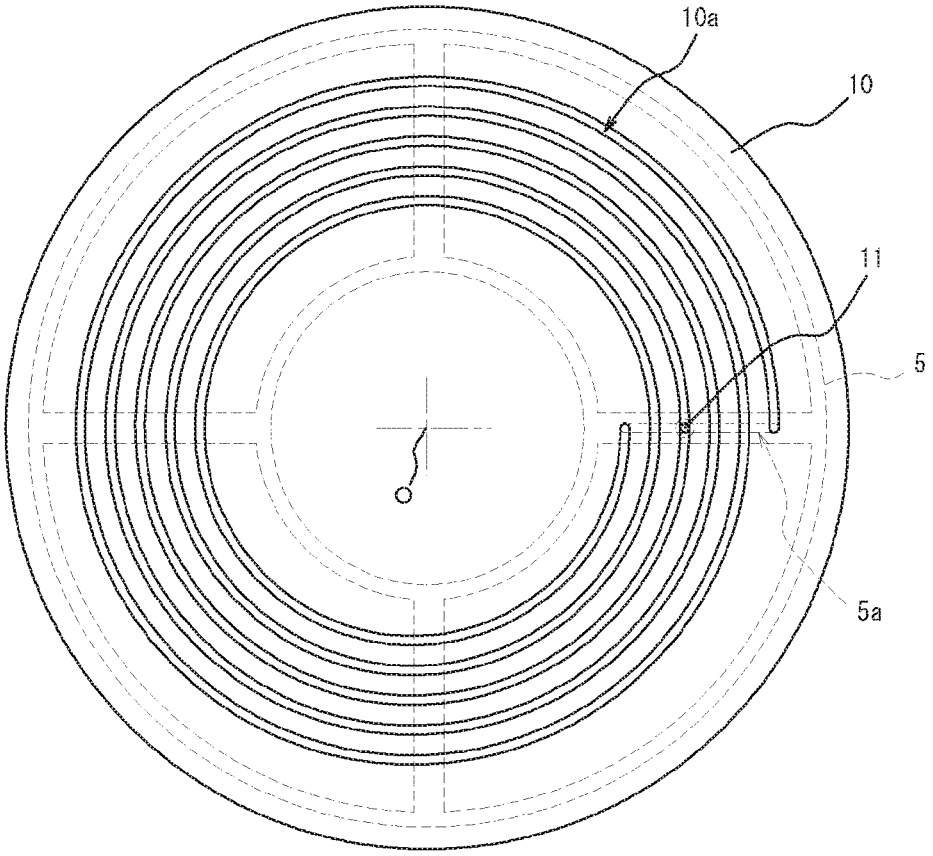
FIG. 6 is a plan view showing a radial groove and a spiral groove.

Although not shown, an upper end portion of the sheet 14 is connected to the upper rotary disc (first rotary disc) 5 located above the upper partition plate 3 as shown in FIGS. 1 and 3, while a lower end portion of the sheet 14 is connected to the lower rotary disc (second rotary disc) 6 located below the lower partition plate 4. The upper rotary disc 5 and the lower rotary disc 6 of the present embodiment have a shape in which a small-diameter doughnut-shaped portion located at the center part and a large-diameter doughnut-shaped portion located radially outward are connected by a total of four frames extending in the radial direction. In addition, as shown in FIG. 6, one frame of the upper rotary disc 5 is provided with a radial groove 5*a* penetrating the frame and extending in the radial direction. Although detailed description of the configuration is omitted, the upper rotary disc 5 and the lower rotary disc 6 are supported so as to rotate with respect to the upper partition plate 3 and the lower partition plate 4.

As shown in FIG. 3, below the upper rotary disc 5, there is provided a rotary-disc drive gear 5*b* that is rotatably supported by the upper partition plate 3 and rotated by the shaft gear 2*c*8. Here, uneven teeth (not shown) to be engaged with the rotary-disc drive gear 5*b* are provided on a lower surface of the upper rotary disc 5 on the radially outer side, and the upper rotary disc 5 is rotated via the rotary-disc drive gear 5*b* when the shaft gear 2*c*8 rotates. In FIG. 3, the shaft gear 2*c*8 and the rotary-disc drive gear 5*b* are illustrated separately. However, a gear (not shown) is provided between the shaft gear 2*c*8 and the rotary-disc drive gear 5*b*, and the shaft gear 2*c*8 and the rotary-disc drive gear 5*b* indirectly mesh with each other in the state shown in FIG. 3 (a state where the shaft 2*c*6 is urged upward by the spring S1). Furthermore, as shown in FIG. 3, the upper rotary disc 5 also includes uneven teeth (driving engagement part 5*c*) on an upper surface on the radially inner side.

Further, between the upper rotary disc 5 and the lower rotary disc 6, a synchronizing mechanism to synchronously rotate these discs is provided. In the present embodiment, as shown in FIGS. 1 and 3, two synchronizing gears 7 are provided, and one of the synchronizing gears 7 meshes with uneven teeth (not shown) meshing with the above-mentioned rotary-disc drive gear 5*b*, while another synchronizing gear 7 meshes with teeth (not shown) provided on an upper surface of the lower rotary disc 6 on the radially outer side. As a result, when the upper rotary disc 5 rotates, the lower rotary disc 6 can also synchronously rotate. Note that the synchronizing mechanism is not limited to the synchronizing gear 7, but the upper rotary disc 5 may be connected to the lower rotary disc 6 via, for example, a toothed belt (which may also be a toothless belt).

As shown in FIG. 1, the connecting member 8 having a substantially cylindrical shape is provided on the radially inner side of the upper rotary disc 5 and the lower rotary disc 6. The connecting member 8 is connected to the upper partition plate 3 and the lower partition plate 4, while rotatably supporting the upper rotary disc 5 and the lower rotary disc 6.

The knob 9 is provided above the connecting member 8 as shown in FIGS. 1 and 3. The knob 9 of the present embodiment forms a shape in which a disc-shaped portion including a plate-shaped portion extending upward is connected to inside a small-diameter cylindrical portion 9*a*, and a large-diameter cylindrical portion 9*b* extending downward is connected to an outer end of a flange connected to an upper end of the small-diameter cylindrical portion 9*a*. In the knob 9, a lower end of the small-diameter cylindrical portion 9*a* abuts against an upper end of the second support part 2*c*9, while an outer surface of the small-diameter cylindrical portion 9*a* is in contact with an inner surface of the connecting member 8, and the knob 9 is supported to be vertically movable along the center axis O and rotatable around the center axis O. Here, when the knob 9 is depressed, the small-diameter cylindrical portion 9*a* depresses the second support part 2*c*9, so that the shaft 2*c*6 also moves downward (the small-diameter cylindrical portion 9*a* functions as a shaft movement engagement part that moves the shaft 2*c*6). Although not shown, since the knob 9 moves with respect to the second support part 2*c*9 and the connecting member 8, in order to lower friction (sliding resistance) therebetween, it is preferable that the lower end of the small-diameter cylindrical portion 9*a* and the upper end of the second support part 2*c*9 are made arcuate, or small protrusions are provided at a contacting portion, for example.

Although not shown in detail, at a lower end of the large-diameter cylindrical portion 9*b*, the knob 9 includes a driving engaged part 9*c* to be engaged with the driving engagement part 5*c* that is uneven teeth provided on the upper rotary disc 5. As a result, when the knob 9 is depressed and rotated, the driving engagement part 5*c* and the driving engaged part 9*c* mesh with each other, so that the upper rotary disc 5 can be rotated.

Then, the top plate (cover plate) 10 is provided above the upper rotary disc 5 as shown in FIGS. 1 and 3. As shown in FIG. 6, the top plate 10 is provided with a spiral groove 10*a* penetrating the top plate 10 and extending in a spiral shape around the center axis O.

Further, between the upper rotary disc 5 and the top plate 10 as shown in FIGS. 1 and 3, there is provided the pin 11 having a large-diameter cylindrical shape at a center part and a small-diameter cylindrical shape at a top and bottom. As shown in FIGS. 3 and 6, the pin 11 is accommodated in the radial groove 5*a* and the spiral groove 10*a*, and moves radially inward or outward in accordance with the rotation of the upper rotary disc 5.

Moreover, the protective plate 12 is provided above the top plate 10. Since the protective plate 12 covers the spiral groove 10*a*, entering of dust and the like to the music box device 1 can be prevented. Further, the protective plate 12 of the present embodiment is transparent, so that a position of the pin 11 can be seen from outside.

The bottom plate 13 together with the top plate 10 and the protective plate 12 forms a casing of the music box device 1, and accommodates the above-described members inside as shown in FIG. 3.

The lock mechanism 15 shown in FIGS. 3 and 5 is for maintaining the shaft 2*c*6 at a lower position when the knob 9 is depressed. In the present embodiment, the lock mechanism 15 includes: a disc 15*a* rotatably held at a center part of the bottom plate 13; a pair of levers 15*b* axially supported by the disc 15*a*; a spring S2 to apply an urging force to the levers 15*b* toward the radially outer side; and a lock member 15*c* axially supported by the levers 15*b* and having a tip inserted into the recess 2*c*11 of the second support part 2*c*9. Here, on an upper surface of the disc 15*a*, uneven teeth (not shown) are provided to mesh with the locking gear 2*c*10 provided on the shaft 2*c*6 when the knob 9 is depressed. Then, in a state where the teeth of the locking gear 2*c*10 mesh with the teeth of the disc 15*a*, when the locking gear 2*c*10 rotates along with the rotation of the shaft 2*c*6, the disc 15*a* rotates so as to return the lock member 15*c* radially inward.

The shaft depression assisting mechanism 16 shown in FIGS. 3 and 5 is for assisting such that the shaft 2*c*6 is entirely lowered (in particular, a portion provided with the fourth gear 2*c*5 and the like distant from the knob 9) when the knob 9 is depressed. The shaft depression assisting mechanism 16 of the present embodiment includes a second shaft 16*a* extending in parallel with the shaft 2*c*6, and includes a pair of arms 16*b* having long holes inserted with the shaft 2*c*6 at both ends of the second shaft 16*a*, and shaft depression assisting mechanism 16 is formed in a U-shape as a whole. Although not shown, the second shaft 16*a* is swingably supported by a support part provided on the bottom plate 13. Therefore, as shown in FIG. 8(*a*), both of the arms 16*b* can be moved at a same angle.

In the music box device 1 having such a configuration, as shown in FIG. 3, music can be played in a state where the knob 9 is located above (playable state). To play music, firstly the handle 2*c*1 is turned by hand. This causes sequential rotation of the first gear 2*c*2, the second gear 2*c*3, and the third gear 2*c*4, and rotation of the shaft 2*c*6 and the shaft gear 2*c*8 together with the fourth gear 2*c*5, to rotate the upper rotary disc 5 via the rotary-disc drive gear 5*b*. At this time, since the lower rotary disc 6 is synchronously rotated together with the upper rotary disc 5 by the synchronizing gear 7, the helical plate-like sheet 14 having the upper end portion and the lower end portion connected to the upper rotary disc 5 and the lower rotary disc 6 is also synchronously rotated. That is, the sheet 14 can be stably rotated without applying a local load to the sheet 14.

When the sheet 14 is rotated, as shown in FIG. 4, the upper portion (un-played portion) of the helical plate-like sheet 14 placed on the upper partition plate 3 passes through the hole 3*a* and over the star wheel 2*a*. Accordingly, the playing engagement part 14*a* is linked with one claw 2*a*1 of the star wheel 2*a* to rotate the star wheel 2*a*, and another claw 2*a*1 plucks the vibration valve 2*b* to allow a sound to be made. Since the sheet 14 has the helical plate shape and a long overall length, music can be played for a long time. Then, the lower portion (played portion) of the sheet 14 having passed through the star wheel 2*a* passes through the hole 4*a* to be placed below the lower partition plate 4. Thus, in the sheet 14, the un-played portion and the played portion can be stacked to form a layer above the upper partition plate 3 and below the lower partition plate 4, enabling suppression of the thickness of the music box device 1.

Figure 7:
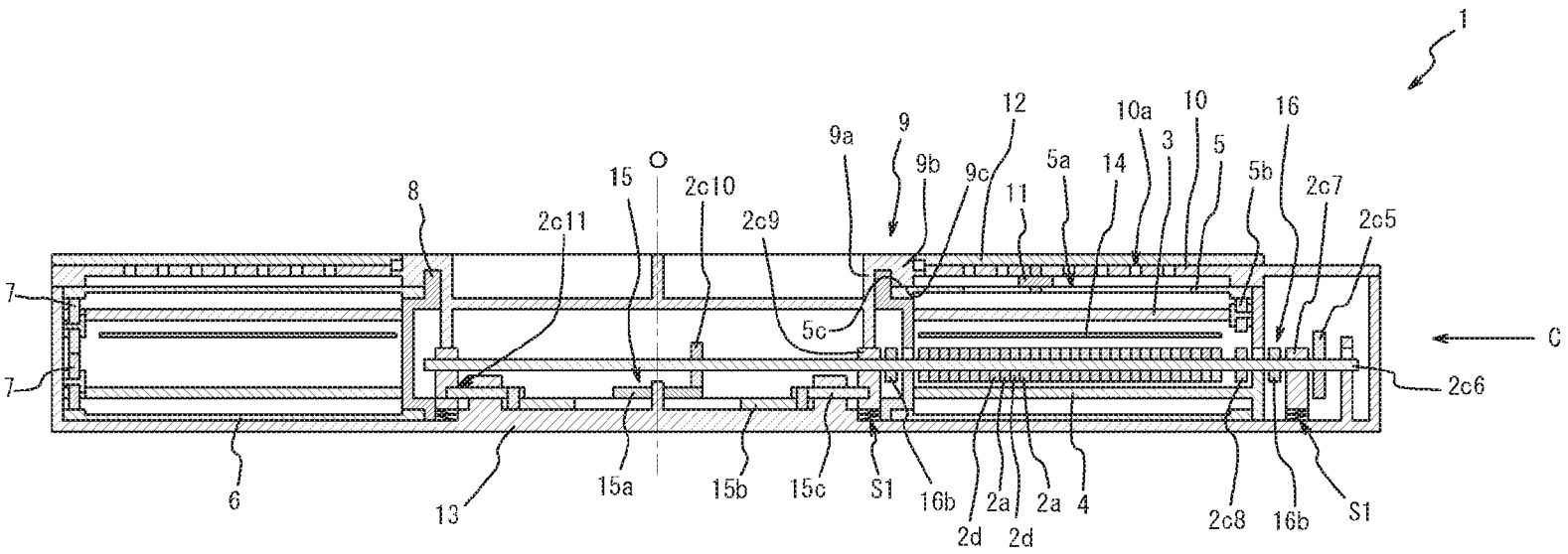
FIG. 7 is a cross-sectional view showing a state where a knob is depressed downward from a state shown in FIG. 3.

Further, as shown in FIG. 7, depressing the knob 9 downward can maintain a state (sheet feeding state) in which the sheet 14 can be fast forwarded or rewound. That is, since the knob 9 lowers the second support part 2*c*9 against the spring S1, the lock member 15*c* urged by the spring S2 shown in FIG. 5 is inserted into the recess 2*c*11. Then, the shaft 2*c*6 is also lowered together with the second support part 2*c*9, the shaft gear 2*c*8 held by the shaft 2*c*6 is separated from the rotary-disc drive gear 5*b*, and the star wheel 2*a* is separated from the sheet 14. Whereas, since the driving engaged part 9*c* of the knob 9 is engaged with the driving engagement part 5*c* of the upper rotary disc 5, the sheet 14 can be fast forwarded or rewound at a high speed along with the rotation of the knob 9.

Since the shaft 2*c*6 extends long in the radial direction, a portion provided with the fourth gear 2*c*5 or the like on the radially outer side may not be evenly depressed even when the knob 9 is depressed. However, in the present embodiment, since the arms 16*b* provided at both ends of the second shaft 16*a* can also apply a force to the radially outer portion of the shaft 2*c*6, the shaft 2*c*6 can be horizontally depressed.

The pin 11 of the present embodiment is configured to move from the radially outer side to the inner side along the radial groove 5*a* as the playing of the sheet 14 progresses. That is, since the position of the pin 11 shows the playing process of the sheet 14, for example, marking the protective plate 12 for each start of music enables the start of the music to be found by feeding the sheet 14 so as to match the pin 11 with the mark.

Although music cannot be played in a state where the knob 9 is depressed downward, turning the handle 2*c*1 also rotates the shaft 2*c*6 since the third gear 2*c*4 and the fourth gear 2*c*5 mesh with each other even in this state as described above. At this time, as shown in FIG. 7, the disc 15*a* and the locking gear 2*c*10 mesh with each other, and the locking gear 2*c*10 and the disc 15*a* are also rotated along with the rotation of the shaft 2*c*6 to cause the lock member 15*c* to be returned radially inward, which releases the linkage between the second support part 2*c*9 and the lock member 15*c*, and causes the knob 9 to be automatically returned upward by the urging force of the spring S1. That is, even when the knob 9 is depressed downward, it is unnecessary to move the knob 9 upward, but the playable state can be restored by simply turning the handle 2*c*1 for playing music as usual.

Next, another embodiment of the music box device according to the present invention will be described with reference to FIGS. 9 to 15. A music box device 51 of the present embodiment includes: a music box body 52; an upper partition plate 53; a lower partition plate 54; an upper rotary disc (first rotary disc) 55; a lower rotary disc (second rotary disc) 56; a synchronizing gear 57; a connecting member 58; a knob 59; a top plate (cover plate) 60; a pin 61; a bottom plate 63; and a sheet 64. Further, the music box device 51 includes a sheet pressing mechanism 65 shown in FIGS. 9 and 10, and a mode switching mechanism 66. Note that the upper partition plate 53, the lower partition plate 54, the upper rotary disc 55, the lower rotary disc 56, the synchronizing gear 57, the connecting member 58, the pin 61, and the sheet 64 have substantially the same configuration as that of the upper partition plate 3, the lower partition plate 4, the upper rotary disc 5, the lower rotary disc 6, the synchronizing gear 7, the connecting member 8, the pin 11, and the sheet 14 in the above-described music box device 1, so that detailed description will be omitted.

Figure 9:
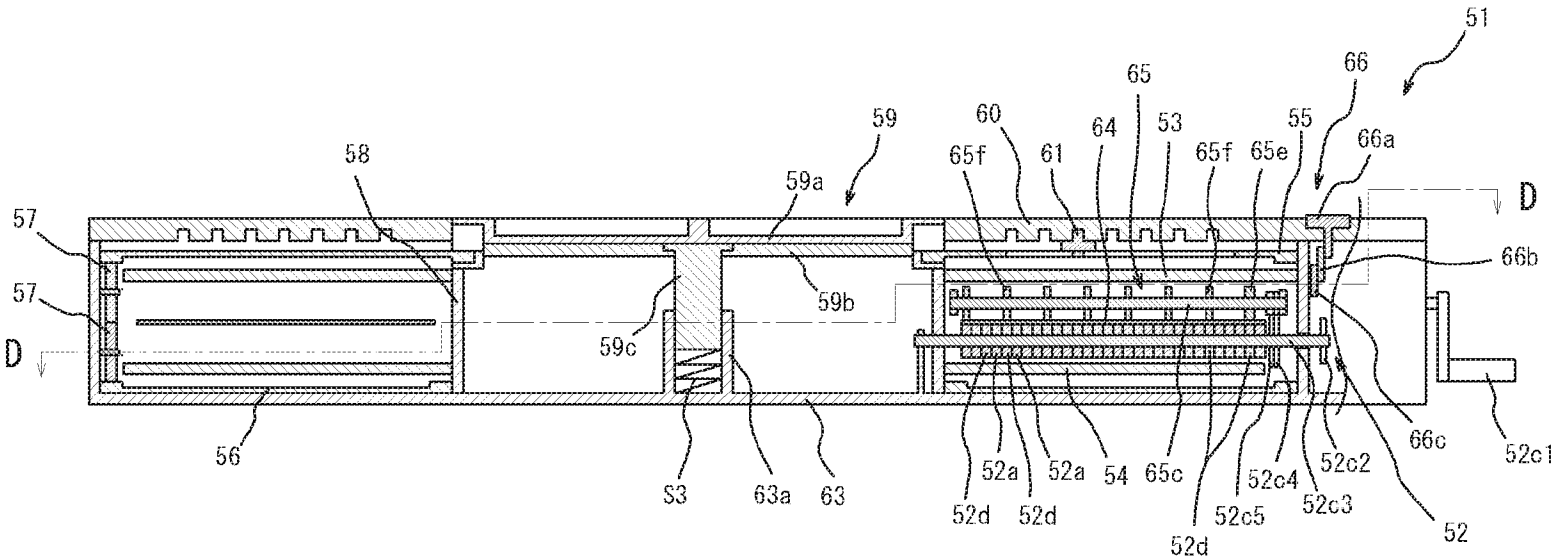
FIG. 9 is a cross-sectional view in a side view showing another embodiment of the music box device according to the present invention.
Figure 10:
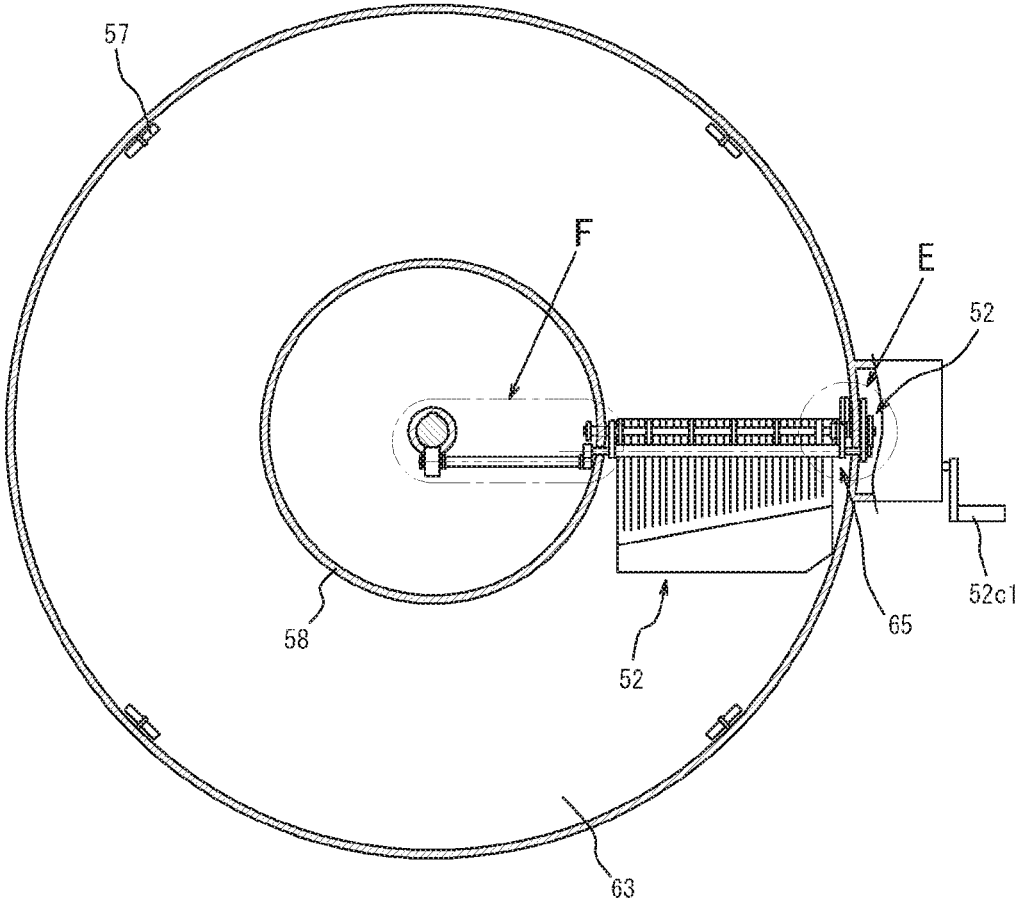
FIG. 10 is a cross-sectional view taken along line D-D shown in FIG. 9.

The music box body 52 includes a star wheel (reference numeral 52*a* in FIG. 9), a vibration valve (reference numeral omitted), and a driving means (reference numeral omitted). Note that the star wheel 52*a* and the vibration valve have substantially the same form as that of the music box body 2 described above, but a configuration of the driving means is partially different from the driving means 2*c* described above. The driving means of the present embodiment is configured such that a rotational force of the handle 52*c*1 shown in FIG. 9 is transmitted to a first drive gear 52*c*2 via a gear (not shown). Here, the first drive gear 52*c*2 is provided on a shaft 52*c*3 that holds a plurality of the star wheels 52*a* so as to skewer the star wheels 52*a* to be idly rotatable. Moreover, between adjacent star wheels 52*a*, as in the above-mentioned spacer 2*d*, there is provided a spacer 52*d* that forms a disc shape and is rotated integrally with the shaft 52*c*3. Further, on the shaft 52*c*3, there are provided a second drive gear 52*c*4 and a third drive gear 52*c*5 that are rotated integrally with the shaft 52*c*3. Although the shaft 2*c*6 in the above-described embodiment is movable in the vertical direction, the shaft 52*c*3 of the present embodiment is configured not to move in the vertical direction.

Figure 13:
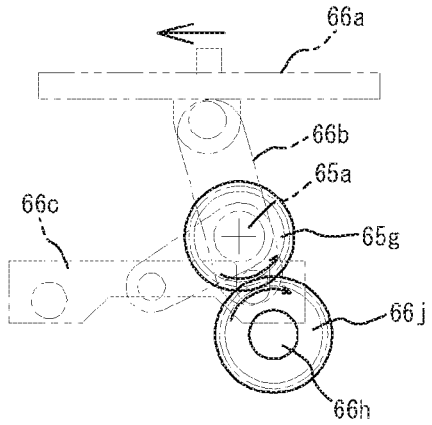
FIG. 13 is a cross-sectional view showing the playable state of the music box device shown in FIG. 9, in which FIG. 13(*a*) is a cross-sectional view taken along line e-e shown in FIG. 11, and FIG. 13(*b*) is a cross sectional view taken along line f-f shown in FIG. 11.
Figure 13:
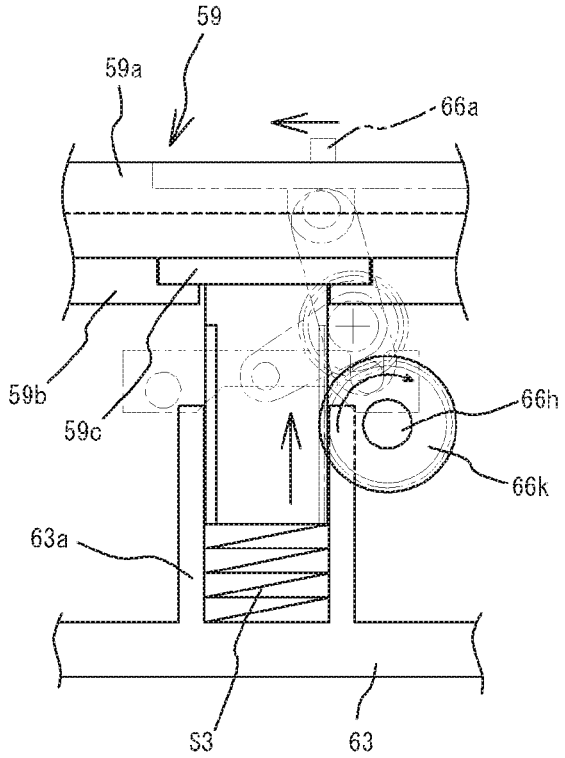

The knob 59 includes: an upper knob part 59*a* serving as a portion to be picked by fingers; a plate-shaped lower knob part 59*b* having a hole in a center part; and a knob shaft part 59*c* inserted through the hole of the lower knob part 59*b* and sandwiched between the upper knob part 59*a* and the lower knob part 59*b*. Moreover, a rack is provided on a side surface of the knob shaft part 59*c* as shown in FIG. 13(*b*). Although not shown, the knob 59 is provided with a portion corresponding to the above-described driving engaged part 9*c* to fast forward or rewind the upper rotary disc 55.

The top plate 60 has such a form that the top plate 10 and the protective plate 12 in the above-described embodiment are integrated. Although the top plate 60 may be entirely transparent, it is preferable that only a spiral groove in which the pin 61 moves is made transparent while the other parts are colored, in appearance.

The bottom plate 63 has a cylindrical portion 63*a* at a center part. The cylindrical portion 63*a* holds the knob shaft part 59*c* slidably. Further, the cylindrical portion 63*a* is provided with a spring S3 that urges the knob shaft part 59*c* upward.

Figure 11:
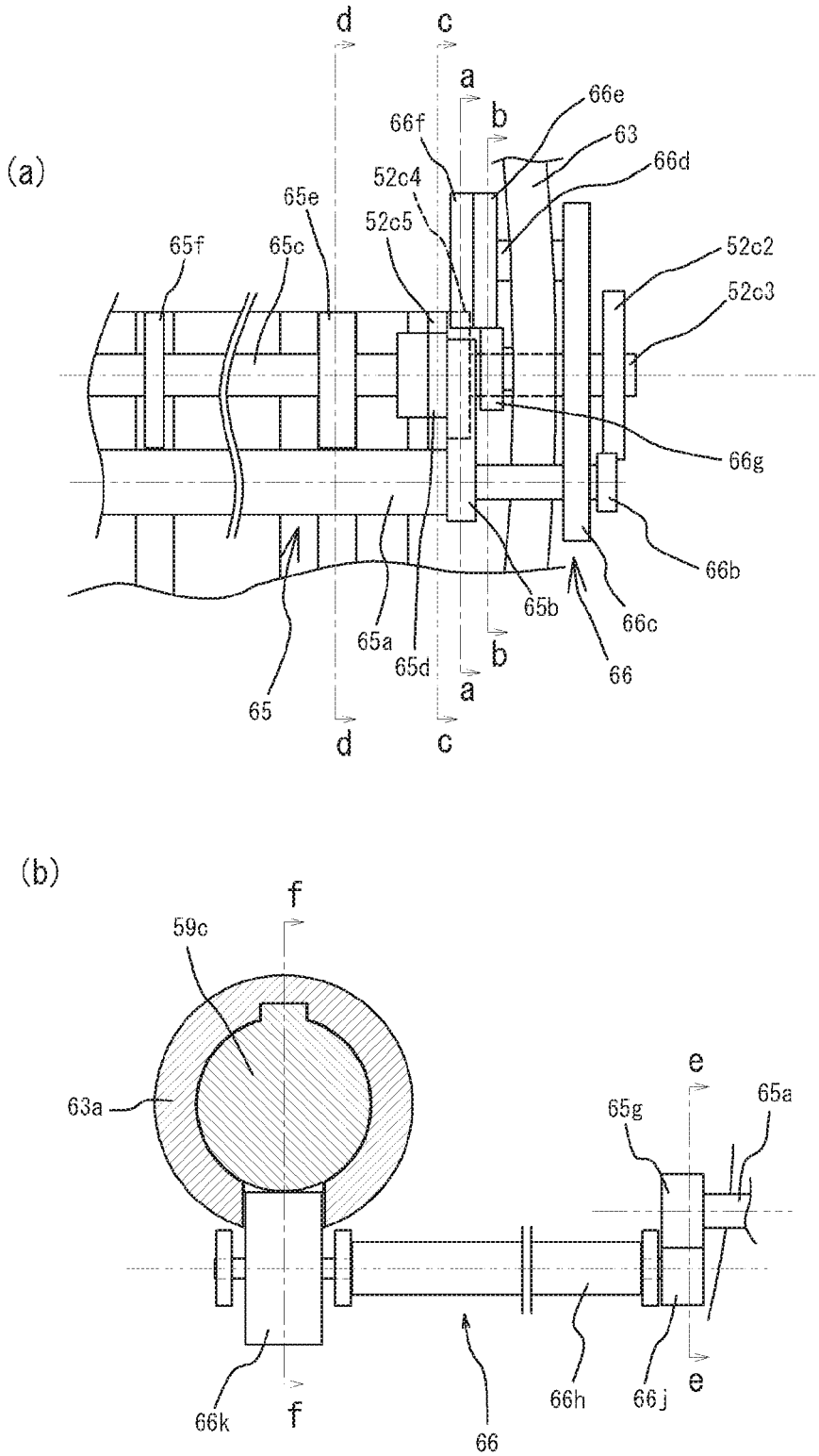
FIG. 11 is a partially enlarged view of FIG. 10, in which FIG. 11(*a*) shows a part E and FIG. 11(*b*) shows a part F.

The sheet pressing mechanism 65 is provided on an opposite side to the star wheel 52*a* and the spacer 52*d* with the sheet 64 interposed therebetween, and sandwiches the sheet 64 in between with the spacer 52*d* to feed out the sheet 64. As shown in FIGS. 9, 11(*a*), and 12(*c*), the sheet pressing mechanism 65 of the present embodiment includes: a swing shaft 65*a* provided to be swingable with respect to the mode switching mechanism 66; an arm 65*b* integrally connected to the swing shaft 65*a*; a drive shaft 65*c* rotatably held by the arm 65*b*; a shaft gear 65*d* to be rotated integrally with the drive shaft 65*c*; a driving roller 65*e* that is rotated integrally with the drive shaft 65*c* and sandwiches the sheet 64 in between with the spacer 52*d* to feed out the sheet 64; and a pressing roller 65*f* mounted on the drive shaft 65*c* to bring the sheet 64 toward the spacer 52*d*. In other words, the pressing roller 65*f* does not have a function of positively feeding out the sheet 64 while bringing the sheet 64 close toward the spacer 52*d*. In order not to provide such a function to the pressing roller 65*f*, for example, while the pressing roller 65*f* is configured to be rotated integrally with the drive shaft 65*c*, a diameter of the pressing roller 65*f* may be made smaller than a diameter of the driving roller 65*e*. Further, even if the diameter is the same as that of the driving roller 65*e*, the pressing roller 65*f* may be configured to be idly rotated with respect to the drive shaft 65*c*. Further, the pressing roller 65*f* may have a same width as the driving roller 65*e*, but the width is preferably made narrower than that of the driving roller 65*e* as shown in FIG. 11(*a*) in order not to positively feed out the sheet 64. Further, the swing shaft 65*a* includes a shaft gear 65*g* as shown in FIG. 11(*b*).

The mode switching mechanism 66 switches between the playable state and the sheet feeding state described in the above embodiment. As shown in FIGS. 9, 11(*a*), and 12(*a*), the mode switching mechanism 66 of the present embodiment includes: a slide switch 66*a* that moves along a top surface of the top plate 60; a first link 66*b* provided to be rotatable around the swing shaft 65*a*; and a second link 66*c* provided movably in a horizontal direction. The second link 66*c* is provided with a shaft 66*d*, and the shaft 66*d* is provided with a first switching gear 66*e*. The first switching gear 66*e* is provided with a second switching gear 66*f* that is rotated integrally with the first switching gear 66*e*. As shown in FIGS. 11(*a*) and 12(*b*), an idler 66*g* attached to a wall rising from the bottom plate 63 is provided beside the first switching gear 66*e*. A rotary-disc drive gear similar to the rotary-disc drive gear 5*b* provided on the above-mentioned upper rotary disc 5 is provided on an outer edge of the upper rotary disc 55, and the idler 66*g* meshes with this rotary-disc drive gear.

Further, as shown in FIG. 11(*b*), the mode switching mechanism 66 includes a switching shaft 66*h*. At one end of the switching shaft 66*h*, a third switching gear 66*j* to mesh with the shaft gear 65*g* is provided. Further, at the other end of the switching shaft 66*h*, a fourth switching gear 66*k* is provided. Here, as shown in FIG. 13(*b*), the fourth switching gear 66*k* meshes with the rack of the knob shaft part 59*c*.

Figure 12:
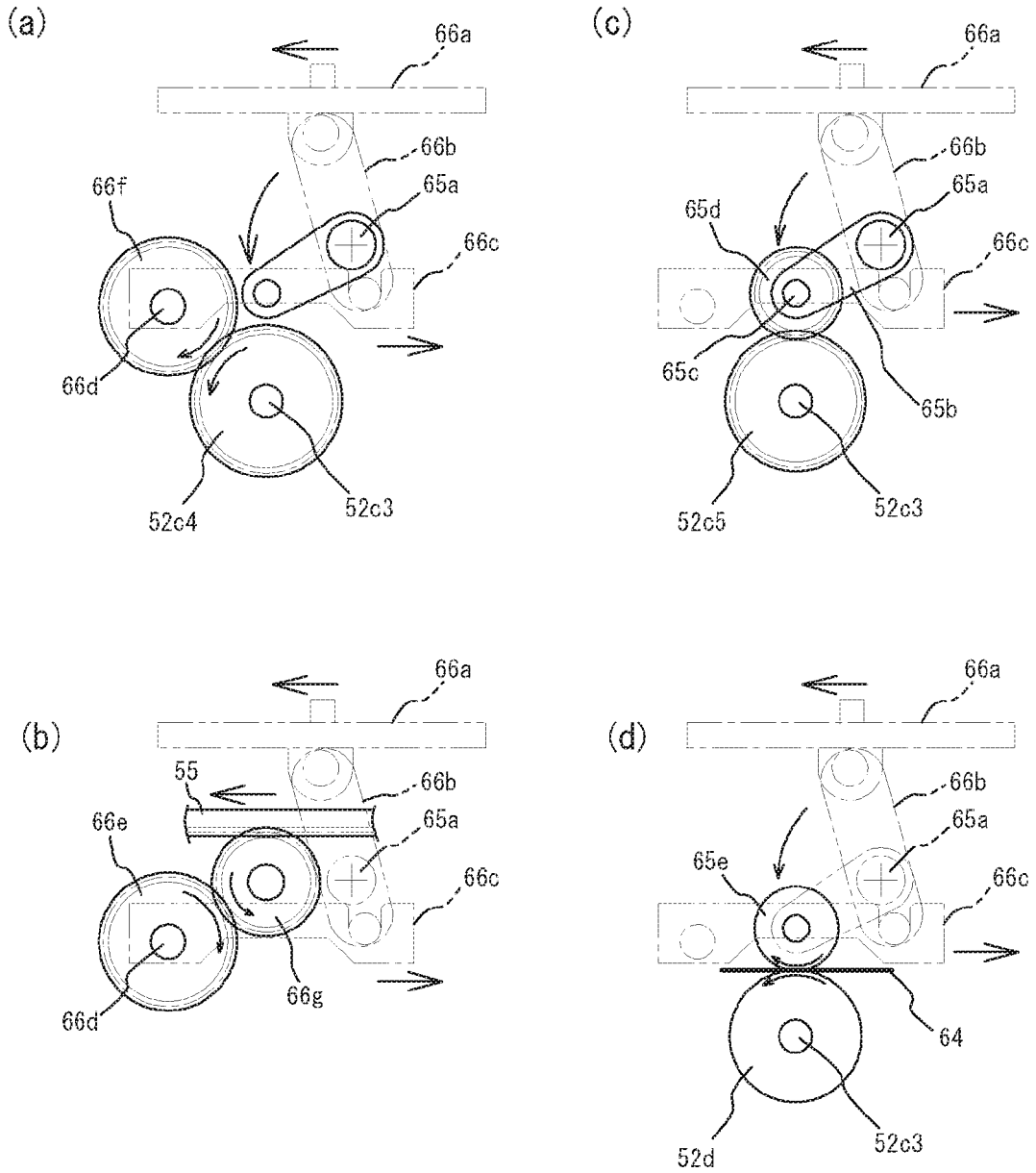
FIG. 12 is a cross-sectional view showing a playable state of the music box device shown in FIG. 9, in which FIG. 12(*a*) is a cross-sectional view taken along line a-a shown in FIG. 11, FIG. 12(*b*) is a cross sectional view taken along line b-b shown in FIG. 11, FIG. 12(*c*) is a cross-sectional view taken along line c-c shown in FIG. 11, and FIG. 12(*d*) is a cross sectional view taken along line d-d shown in FIG. 11.

In the music box device 51 having such a configuration, when the slide switch 66*a* is moved in a direction of an arrow (left side) shown in FIG. 12(*a*) in order to bring the music box device 51 into the playable state, the first link 66*b* is rotated counterclockwise around the swing shaft 65*a*, and the second link 66*c* moves to the right side. At this time, the second switching gear 66*f* meshes with the second drive gear 52*c*4, while the first switching gear 66*e* meshes with the idler 66*g* as shown in FIG. 12(*b*). Therefore, the rotational force of the handle 52*c*1 is transmitted to the upper rotary disc 55 via the idler 66*g*, to cause rotation of the upper rotary disc 55. Further, since the lower rotary disc 56 is also rotated via the synchronizing gear 57 when the upper rotary disc 55 is rotated, the sheet 64 connected to these is also rotated.

Furthermore, in this state, as shown in FIG. 12(*c*), since the arm 65*b* connected to the swing shaft 65*a* is also rotated counterclockwise, the shaft gear 65*d* meshes with the third drive gear 52*c*5. Therefore, the rotational force of the handle 52*c*1 is transmitted to the drive shaft 65*c* via the shaft gear 65*d*, to also cause rotation of the driving roller 65*e* as shown in FIG. 12(*d*). This causes the sheet 64 sandwiched between the spacer 52*d* and the driving roller 65*e* to be fed out by both of the spacer 52*d* and the driving roller 65*e*, enabling stable rotation of the sheet 64. Further, as shown in FIGS. 9 and 11(*a*), a plurality of pressing rollers 65*f* are provided on the drive shaft 65*c*, and the entire area in the radial direction of the sheet 64 is brought toward the spacer 52*d* by the driving roller 65*e* and the pressing roller 65*f*. That is, since the sheet 64 is also brought close to the star wheel 52*a* adjacent to the spacer 52*d*, the claw provided on the star wheel 52*a* can be reliably meshed with the playing engagement part provided on the sheet 64, so that music can be played as expected. Meanwhile, since the sheet 64 is circular in a plan view, a speed is different between the inner side and the outer side in the radial direction. Therefore, if a configuration is adopted in which the pressing roller 65*f* also applies a driving force similarly to the driving roller 65*e*, the configuration is required to be such that a rotational speed corresponding to the radial position of the sheet 64 is given to each of the rollers, in order to avoid wrinkles on the sheet 64 and twists of the sheet 64. However, in the present embodiment, the one driving roller 65*e* is the only roller to apply the driving force to the sheet 64, and the other pressing roller 65*f* has a smaller diameter and a smaller width than the driving roller 65*e*, preventing the pressing roller 65*f* from applying an unnecessary load to the sheet 64. This can prevent wrinkles and twists of the sheet 64 with a simple structure. In the present embodiment, a speed of the idler 66*g* on a circumference of a pitch circle is set to be (radial length from the center axis of the upper rotary disc 55 to the idler 66*g*)/(radial length from the center axis of the upper rotary disc 55 to the driving roller 65*e*) with respect to a speed of the driving roller 65*e* on a circumference. That is, since the rotational speed of the upper rotary disc 55 and the lower rotary disc 56 is equal to the rotational speed of the sheet 64, they can be rotated in synchronization.

Further, in this state, as shown in FIG. 13(*a*), since the shaft gear 65*g* connected to the swing shaft 65*a* is rotated counterclockwise while the third switching gear 66*j* meshing with the shaft gear 65*g* is rotated clockwise, the fourth switching gear 66*k* connected to the third switching gear 66*j* via the switching shaft 66*h* is also rotated clockwise as shown in FIG. 13(*b*). Here, since the knob 59 has the knob shaft part 59*c* having the rack meshing with the fourth switching gear 66*k*, the knob 59 moves up to a standby position above.

Figure 14:
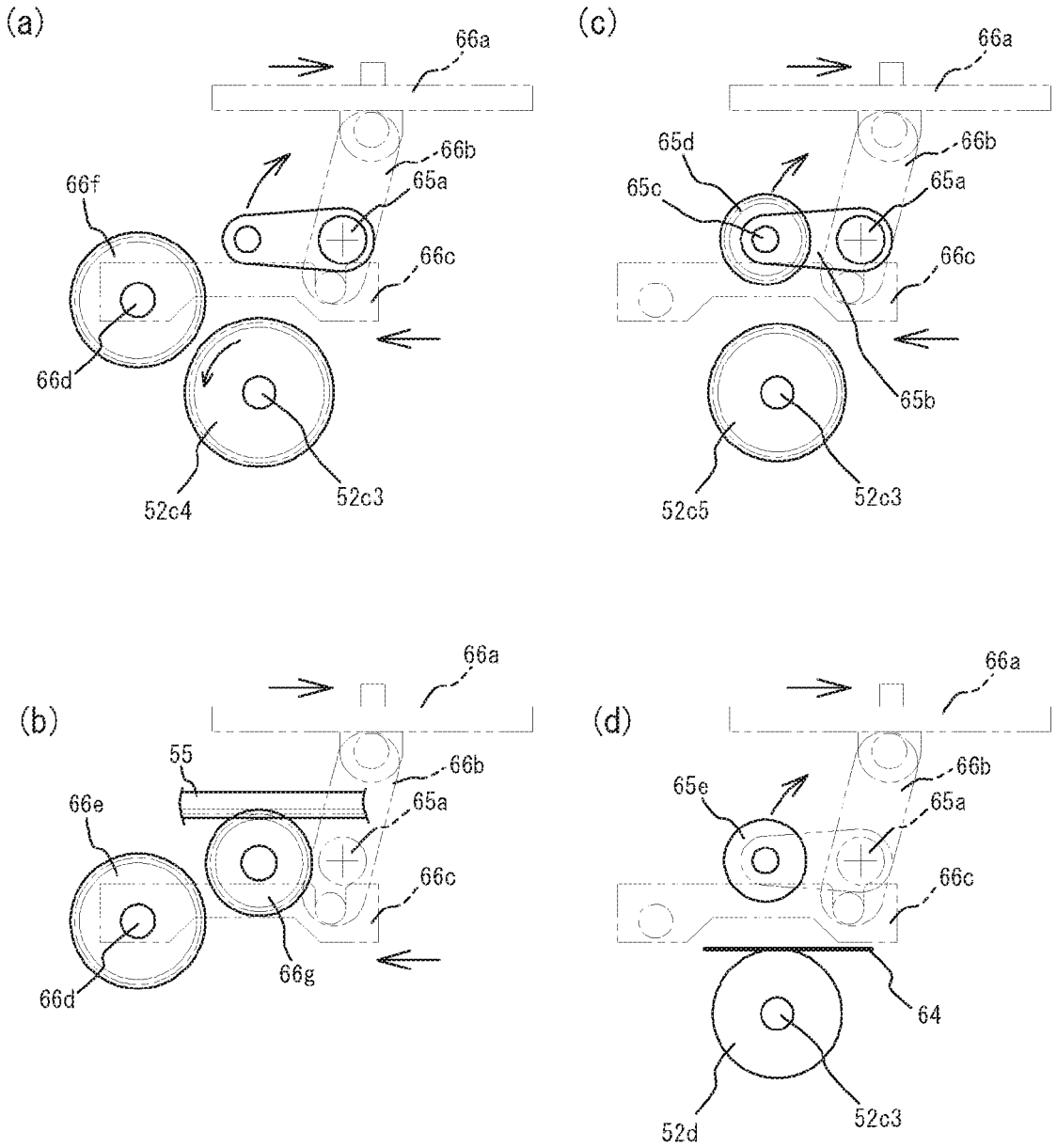
FIG. 14 is a cross-sectional view showing a sheet feeding state of the music box device shown in FIG. 9, in which FIG. 14(*a*) is a cross-sectional view taken along line a-a shown in FIG. 11, FIG. 14(*b*) is a cross sectional view taken along line b-b shown in FIG. 11, FIG. 14(*c*) is a cross-sectional view taken along line c-c shown in FIG. 11, and FIG. 14(*d*) is a cross sectional view taken along line d-d shown in FIG. 11.
Figure 15:
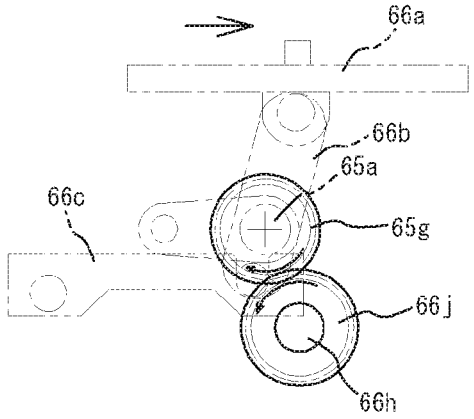
FIG. 15 is a cross-sectional view showing the sheet feeding state of the music box device shown in FIG. 9, in which FIG. 15(*a*) is a cross-sectional view taken along line e-e shown in FIG. 11, and FIG. 15(*b*) is a cross sectional view taken along line f-f shown in FIG. 11.
Figure 15:
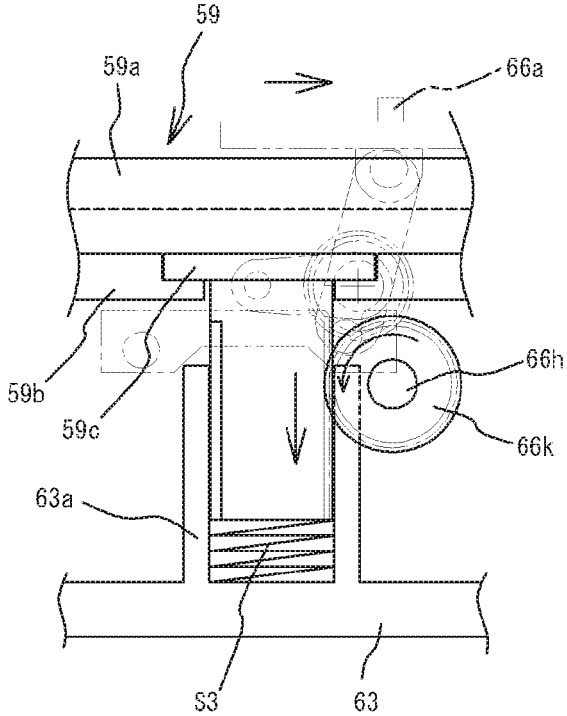

Whereas, in order to bring the music box device into the sheet feeding state, the slide switch 66*a* is moved in the direction of an arrow (right side) shown in FIG. 14(*a*). As a result, the first link 66*b* is rotated clockwise around the swing shaft 65*a*, and the second link 66*c* moves to the left side. At this time, the second switching gear 66*f* moves away from the second drive gear 52*c*4, while the first switching gear 66*e* also moves away from the idler 66*g* as shown in FIG. 14(*b*). Furthermore, in this state, as shown in FIG. 14(*c*), since the arm 65*b* connected to the swing shaft 65*a* is also rotated clockwise, the shaft gear 65*d* also moves away from the third drive gear 52*c*5, and the driving roller 65*e* also moves away from the star wheel 52*a* as shown in FIG. 14(*d*). That is, the rotational force of the handle 52*c*1 is not transmitted to the upper rotary disc 55, the lower rotary disc 56, and the sheet 64. Further, in this state, as shown in FIG. 15(*a*), since the shaft gear 65*g* connected to the swing shaft 65*a* is rotated clockwise and the third switching gear 66*j* is rotated counterclockwise, the fourth switching gear 66*k* is also rotated counterclockwise as shown in FIG. 13(*b*). As a result, since the knob 59 is moved downward via the knob shaft part 59*c*, and a driving engaged part (not shown) provided on the knob 59 is engaged with a driving engagement part (not shown) provided on the upper rotary disc 55, the sheet 64 can be fast forwarded or rewound at a high speed along with the rotation of the knob 59.

The music box device of the present invention is not limited to the embodiments described above, but includes various modifications. For example, in the drawings used in the description of the present embodiment, each component member is shown in a simplified manner, but not limited to this form. Further, in the above-described embodiment, the handle 2*c*1 to be turned by hand is provided as a driving part to rotate the sheet 14, but the sheet 14 may be rotated by a motor.

INDUSTRIAL APPLICABILITY

According to the music box device of the present invention, since it is possible to play music for a long time and also suppress the thickness, it is suitable not only for use of the music box device alone but also for use in combination with other articles.

REFERENCE SIGNS LIST

1 music box device
2 music box body
2*a* star wheel
2*a*1 claw
2*b* vibration valve
2*c* driving means
2*c*1 handle
2*c*2 first gear
2*c*3 second gear
2*c*4 third gear
2*c*5 fourth gear
2*c*6 shaft
2*c*7 first support part
2*c*8 shaft gear
2*c*9 second support part
2*c*10 locking gear
2*c*11 recess
2*d* spacer
3 upper partition plate
3*a* hole of upper partition plate
4 lower partition plate
4*a* hole of lower partition plate
5 upper rotary disc (first rotary disc)
5*a* radial groove
5*b* rotary-disc drive gear
5*c* driving engagement part
6 lower rotary disc (second rotary disc)
7 synchronizing gear (synchronizing mechanism)
8 connecting member
9 knob
9*a* small-diameter cylindrical portion (shaft movement engagement part)
9*b* large-diameter cylindrical portion
9*c* driving engaged part
10 top plate (cover plate)
10*a* spiral groove
11 pin
12 protective plate
13 bottom plate
14 sheet
14*a* playing engagement part
15 lock mechanism
15*a* disc
15*b* lever
15*c* lock member
16 shaft depression assisting mechanism
16*a* second shaft
16*b* arm
51 music box device
52 music box body
52*a* star wheel
52*c*1 handle
52*c*2 first drive gear
52*c*3 shaft
52*c*4 second drive gear
52*c*5 third drive gear
52*d* spacer
53 upper partition plate
54 lower partition plate
55 upper rotary disc (first rotary disc)
56 lower rotary disc (second rotary disc)
57 synchronizing gear (synchronizing mechanism)
58 connecting member
59 knob
59*a* upper knob part
59*b* lower knob part
59*c* knob shaft part
60 top plate (cover plate)
61 pin
63 bottom plate
63*a* cylindrical portion
64 sheet
65 sheet pressing mechanism
65*a* swing shaft
65*b* arm
65*c* drive shaft
65*d* shaft gear
65*e* driving roller
65*f* pressing roller
65*g* shaft gear
66 mode switching mechanism
66*a* slide switch
66*b* first link
66*c* second link
66*d* shaft
66*e* first switching gear
66*f* second switching gear
66*g* idler
66*h* switching shaft
66*j* third switching gear
66*k* fourth switching gear
S1 spring
S2 spring
S3 spring

The invention claimed is:

1. A music box device comprising: a sheet that has a playing engagement part and is rotated by a driving means; a star wheel arranged oppositely to the sheet and having two or more claws on an outer peripheral surface; and a vibration valve arranged adjacent to the star wheel, wherein as the sheet is rotated by the driving means, the playing engagement part is linked with one claw to rotate the star wheel, and another claw plucks the vibration valve to play music, wherein the sheet has a helical plate shape and a center axis of the sheet is orthogonal to a center axis of the star wheel.

2. The music box device according to claim 1, wherein the driving means includes a first rotary disc connected to one end of the sheet, a second rotary disc connected to another end of the sheet, and a synchronizing mechanism to synchronously rotate the first rotary disc and the second rotary disc.

3. The music box device according to claim 2, further comprising:

a cover plate including a spiral groove provided facing at least one of the first rotary disc and the second rotary disc, and a pin movable in the spiral groove, wherein at least one of the first rotary disc and the second rotary disc facing the cover plate has a radial groove extending in a radial direction and holding the pin movably.

4. The music box device according to claim 2, wherein the driving means includes a shaft to integrally rotate a spacer that holds the star wheel to be idly rotatable and is provided coaxially with the star wheel, and the driving means further includes a sheet pressing mechanism having a driving roller that sandwiches the sheet in between with the spacer and is rotated by the driving means to feed out the sheet and a pressing roller that is mounted to a drive shaft to be rotated together with the driving roller and brings the sheet toward the spacer.

5. The music box device according to claim 4, wherein the driving roller is configured to rotate the sheet at a rotational speed consistent with the first rotary disc and the second rotary disc.

* * * * *